United States Patent [19]

Capper et al.

[11] Patent Number: 4,819,390

[45] Date of Patent: Apr. 11, 1989

[54] SUPPORTING ASSEMBLIES

[76] Inventors: Bruce Capper, 34 Howlett Road; George J. Heelass, 7 Beenwerrin Crescent, both of Capalaba, QLD 4157, Australia

[21] Appl. No.: 800,131

[22] PCT Filed: Feb. 28, 1985

[86] PCT No.: PCT/AU85/00033

§ 371 Date: Oct. 24, 1985

§ 102(e) Date: Oct. 24, 1985

[87] PCT Pub. No.: WO85/03965

PCT Pub. Date: Sep. 12, 1985

[30] Foreign Application Priority Data

Feb. 28, 1984 [AU] Australia ..... PG3810
Aug. 3, 1984 [AU] Australia ..... PG6376
Nov. 1, 1984 [AU] Australia ..... PG7944

[51] Int. Cl.[4] ..... E04B 2/82; E04B 5/60
[52] U.S. Cl. ..... 52/95; 52/741
[58] Field of Search ..... 52/94, 95, 483, 729, 52/648, 741

[56] References Cited

U.S. PATENT DOCUMENTS 3,181,275 5/1965 Schroter et al. .
3,712,015 1/1973 Nelson ..... 52/729
3,994,111 11/1976 Papayoti ..... 52/648
4,226,059 10/1980 Pichette .

FOREIGN PATENT DOCUMENTS 129296 10/1948 Australia .
132932 5/1949 Australia .
209055 6/1957 Australia ..... 52/94
243905 3/1963 Australia .
269055 8/1964 Australia .
290196 4/1966 Australia .
280706 5/1966 Australia .
440515 10/1971 Australia .
472698 4/1975 Australia .
6670174 9/1975 Australia .
970125 7/1975 Canada ..... 52/483

*Primary Examiner*—John E. Murtagh
*Attorney, Agent, or Firm*—McAulay, Fields, Fisher, Goldstein & Nissen

[57] ABSTRACT

A supporting assembly (10) for supporting panels such as soffit panels (11) comprises a supporting beam (20) which may span between spaced supports (13) and (15) and having opposed location means (22) thereon in which the adjacent edges of a pair of panels (11) may be engaged for support thereby. The location means (22) may be spaced apart to permit air to flow therethrough from one side of the panels to the other.

20 Claims, 3 Drawing Sheets

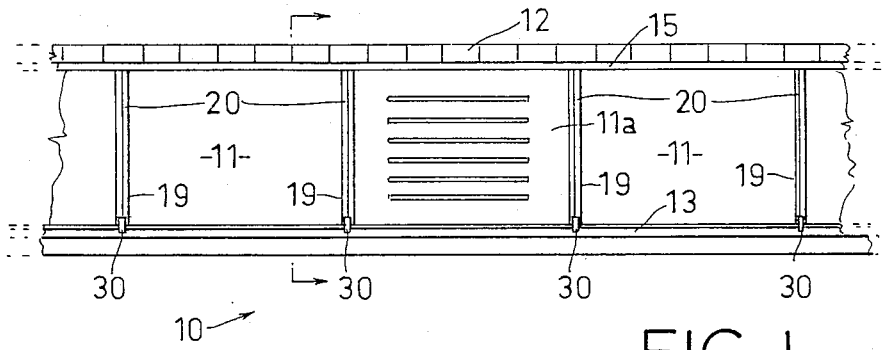
FIG. 1
FIG. 2
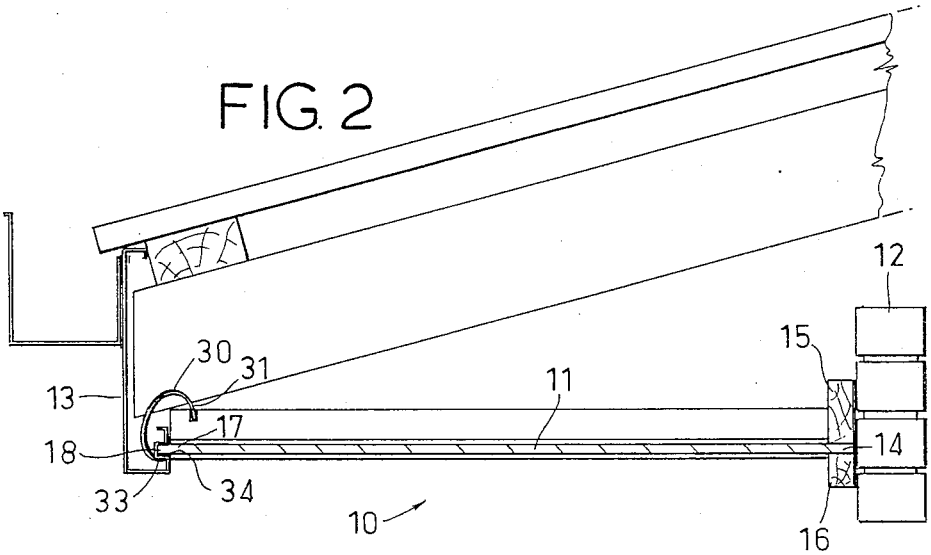
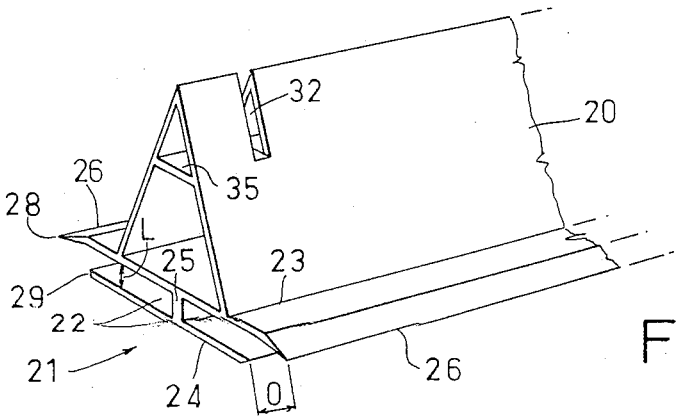
FIG. 3

SUPPORTING ASSEMBLIES

This invention relates to supporting assemblies for supporting panels and to methods of using same.

The present invention has particular application to supporting adjacent edges of relatively thin cladding panels such as soffit panels, but it can be used in other applications such as for connecting together wall panels of any desired thickness.

A typical application of the present invention is in forming soffits and for simplicity, reference will be made hereinafter to this application. At present erecting a soffit is a time consuming operation necessitating the fixing of a plurality of spaced nogging members beneath the overhanging roof and between the wall and on fascia panel so to form a framework to which the soffit panels can be secured. The panels are then secured to this framework with adjacent edges connected to a common nogging extending between the wall and the fascia. H-sectioned mouldings are frequently placed about the adjacent panels edges to form an easily applied finishing strip which conceals the cut edges of the panels. Soffits on dwellings are typically formed 600 mm wide except at window openings and the like where the soffit may extend inward of the wall cladding. At present soffit panels are generally supplied in two widths, namely 600 mm which is utilized for the majority of the soffits and 900 mm which is cut to size to suit window openings and the like. Frequently much of the wider sheets are wasted and extra labour is required to sort through the panels and cut them as required.

In many installations, the outer edges of soffit panels terminate against a metal fascia panel provided with a channel to receive the edge of the soffit. While this facilitates location of the outer side edge of the soffit cladding, the use of a metal fascia makes it difficult for a builder to secure the fascia to the building wall structure to prevent outward buckling intermediate the supporting roof bearers. The use of a metal fascia also makes it very difficult to secure intermediate timber noggings to the fascia in a manner which prevents them from moving during installation of the panels.

Another disadvantage associated with the present soffit installations is that the soffit panels must be provided with apertures to permit ventilation. Ventilated panels are available for this purpose but these are both expensive and difficult to install because they are easily broken. Accordingly most soffit panels are formed with a plurality of ventilating apertures by on-site drilling. This of course is time consuming and adds significantly to the cost of the soffit installation. Furthermore, many panel types such as plaster board are not used in soffit installations because it is very difficult to form on side apertures therethrough without damaging the panels.

The present invention aims to alleviate the above-mentioned disadvantages and to provide a supporting assembly and a method of using same which will be reliable and efficient in use. Other objects and advantages of this invention will hereinafter become apparent.

With the foregoing and other objects in view, this invention in one aspect resides broadly in a supporting assembly for supporting a pair of adjacent panels, said supporting assembly including a substantially rigid supporting body having panel location means thereon for connecting the adjacent edges of said panels thereto. Preferably there are provided a pair of said location means whereby panels may be joined by said supporting assembly in spaced edge to edge relationship. The location means may be arranged to support the panels in co-planar or angularly disposed relationship as desired. Suitably each locaton means includes a continuous outer flange adapted to overlie the respective adjacent edge portion of adjoining panels and the substantially rigid support body comprises a beam section spaced inwardly from said outer flange(s). The beam section may be of hollow section of any desired configuration such as round, square, triangular, octagonal or the like or it may be in the form of an open section such as an I beam or a channel or the like. It is also preferred that there be provided clamping means adapted to engage the face of a panel remote from said outer flange so as to urge the panel towards said outer flange. The clamping means may be formed of resilient material and it may have an edge formation such as a serration adapted to bite into the panel to prevent withdrawal of the panel from the location means.

In a preferred form the supporting assembly is formed from aluminum or a plastics material as a one-piece extrusion having an outer flange connected by a web to a section such as a T member and forming therewith spaced location channels and there being provided clamping means including resilient flanges which extend outwardly beyond the respective free edges of said outer flange and into the space to be occupied by said panel.

In a further aspect this invention resides broadly in a ventilated supporting assembly for supporting a pair of panels in substantially spaced edge to edge relationship and including a supporting body having a pair of spaced location means thereon for supporting the respective edge portions of the panels, whereby an air flow passage or passages may be provided through the supporting assembly between said location means to permit air to pass from one side of the panels to the other. In one form the supporting assembly is an open channel-like section having opposed free edge portions formed as location channels which are spaced apart to permit air to flow therebetween into the interior of said channel-like section. The air may be exhausted therefrom through an open end or ends or through passages formed along a wall or walls of the channel-like section. The latter could be an extruded section formed of metal or a plastics material or it could be a roll-formed section.

In a further aspect, this invention resides in a soffit assembly including a plurality of soffit panels supported in substantially end to end relationship and interconnected by a plurality of supporting assemblies as defined above, and each supporting assembly supporting a respective pair of adjacent edges of the soffit panels.

In another aspect this invention resides in a method of forming a soffit assembly including securing a soffit panel to a wall structure; installing a support assembly on the edge portion of the soffit panel to be connected to the adjacent soffit panel such that the supporting assembly extends substantially the full length of said edge portion to support that edge portion; engaging a further soffit panel with said supporting assembly and securing the further soffit panel to the wall structure, and thereafter installing further soffit panels as herein defined.

In order that this invention may be more readily understood and put into practical effect, reference will now be made to the accompanying drawings which illustrate typical embodiments of the invention, wherein:

FIG. 1 is a plan view of a typical soffit assembly utilizing one form of supporting assemblies of the present invention;

FIG. 2 is a side view of the soffit assembly of FIG. 1;

FIG. 3 is a perspective view of the supporting assembly illustrated in FIG. 1;

Figure 4:
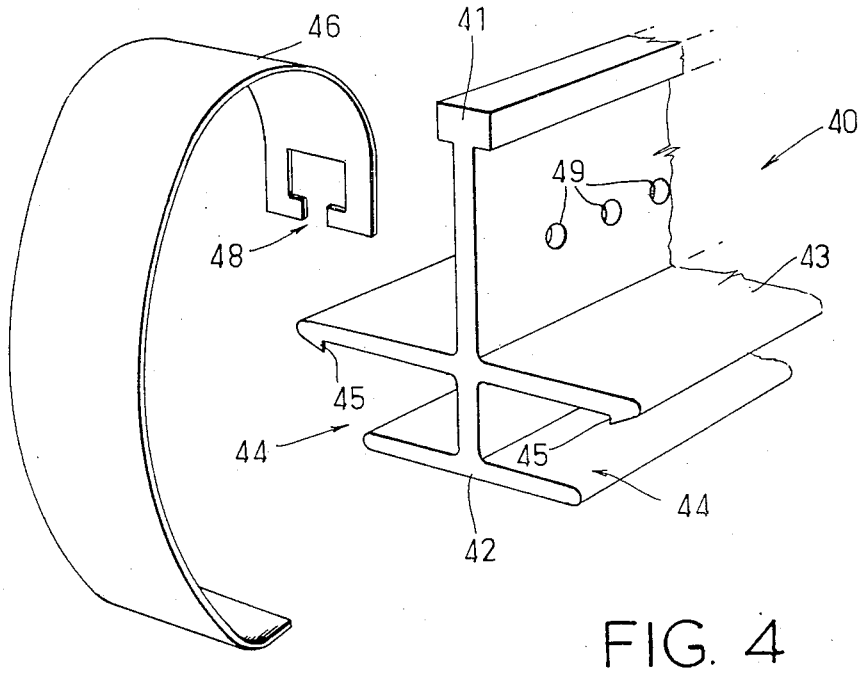
FIG. 4 is a perspective view of an alternate form of supporting assembly.

As shown in FIGS. 1 and 2 a soffit assembly 10 constructed according to this invention includes a plurality of panels 11 extending between a wall 12 and a fascia 13. The panels 11 are nailed or otherwise secured along their inner edge 14 to a pole plate 15 secured to the wall 12, or hung from the rafters, and a cover strip 16 is secured beneath the nailed edge to cover the inner edge of the panels 11. The outer edges 17 of the panels 11 in this embodiment are secured in a recess 18 formed in the rear flange of the roll-formed metal fascia 13. The transverse edge portions 19 of the panels 11 are supported by elongate panel supporting members 20 which span the space between the wall 12 and the fascia 13.

As shown in FIG. 3, each panel supporting member 20 is in the form of an elongate load supporting beam of substantially triangular cross-sectional configuration having a base portion 21 providing opposed location means 22 for supporting the transverse panel edges 19. Each location means 22 is in the form of a channel having a top wall 23 which extends outwardly beyond the base of the A-sectioned member 20 and beyond the outer edge of the base wall 24 which is connected by a side wall or web 25 to the base of the member 20.

The supporting member 20, is preferably formed by extrusion of a resilient material such as a plastics material and the distance L between the base wall 24 and top wall 23 is formed so as to freely accommodate an edge portion of the selected cladding sheet 11. The outer edge portion 26 of the top wall 23 is tapered and deflected inwardly from a position parallel to the base wall 24 to intrude into the zone to be occupied by a panel (illustrated in dotted outline at 11a) whereby in use, the tapered portion 26 will press firmly against the back face of the panel 11a to force it into engagement with the base wall 24 so that a gap will not appear between the panel 11a and the base wall 24.

The top wall 23 projects outwardly beyond the bottom wall 24 to facilitate engagement of a panel in the respective locaton means 22. This arrangement enables a panel to be easily inserted into an elevated supporting member 20 by feeding the panel edge of an inclined panel into the relatively large opening "O" formed between the spaced outer edges 28 and 29 of the walls 23 and 24. Once guided into this opening, the inclined panel 11 may be lifted to a horizontal position and moved to its located position engaged in the channel shaped location means 22 and with its edge adjacent the web 25.

When the supporting members 20 are used in a construction utilizing a roll-formed metal fascia 13, as illustrated in FIGS. 1 and 2, retaining brackets 30 are used to prevent dislodgement of the panel edges 17 from the recesses 18. In one form the retaining bracket 30 is in the form of a spring-steel C shaped clip having a plain top end portion 31 adapted to be retained in a slot 32 (see FIG. 3) formed in the apex of the A-sectioned member 20 and a bottom end portion 33 shaped so as to engage about the back face 34 of the wall and beneath the recess 18. Suitably the slot 32 is cut on site. An intermediate web 35 may be provided in the apex of the member 20 as a stop to limit the depth of the slot 32.

It will be seen in FIGS. 1 and 2 that no nogging members are required intermediate the supporting members 20 so that construction of a soffit according to this invention can proceed rapidly without any conventional nogging being utilized. For example, after the fascia 13 and pole plate 15 are installed, a panel 11 is lifted into position and secured to the pole plate 15. A length of the supporting member 20 is then selected or cut to fit between the fascia 13 and the pole plate 15 and pushed onto the free edge of the panel 11 extending therebetween to support the next panel 11 is then lifted into position with one edge engaged securely in the fascia recess 18 and an adjacent edge engaged in location means 22 of the supporting member 20. This panel is also nailed to the pole plate 15. Further panels are secured in the same manner.

Figure 7:
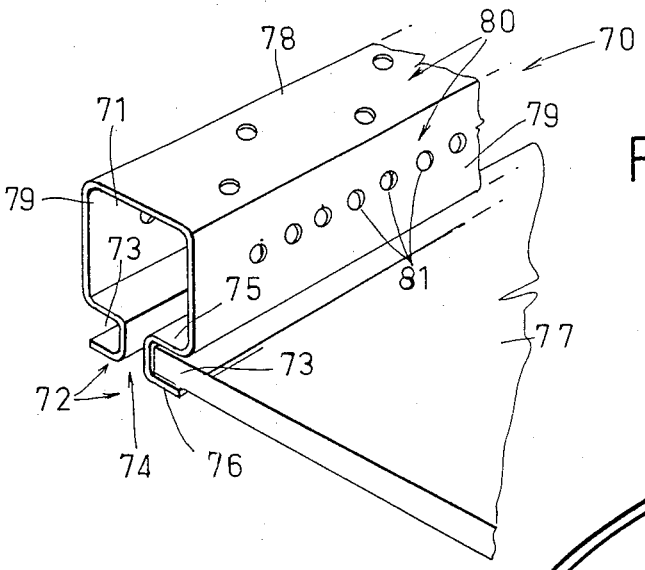
FIG. 7 is a cut-away perspective view illustrating ventilated supporting assembly according to this invention.
Figure 9:
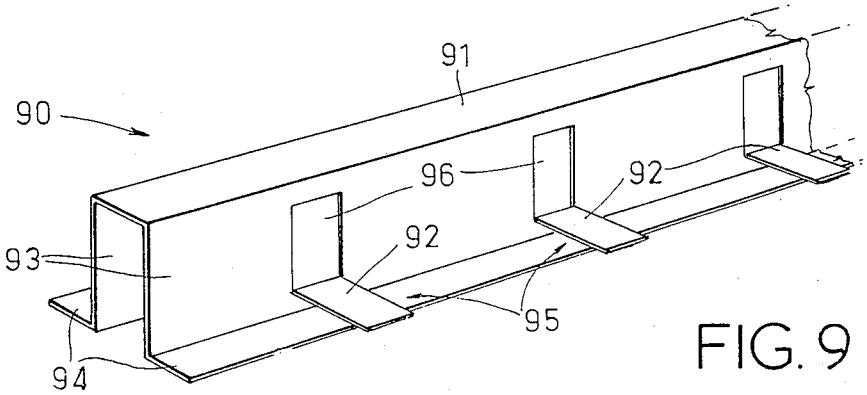
FIG. 9 is a perspective view of an alternate form of ventilated supporting assembly.

Preferably for a soffit 600 mm wide the panels 11 are cut from a 900 mm wide sheet to a width of 600 mm to form panels 600 mm wide×900 mm long. Thus the spacing between supporting assemblies is 900 mm and preferably no intermediate nogging is used. However intermediate nogging may be used if required, depending on the type of cladding sheet used and of course any desired spacing of the supporting members 20 may be used. The trim strip 16 is used to cover the inner edge of the panels 11. Panels above window openings and the like where the width may be greater than 600 mm can be cut from the same sheets. For example a sheet 750 mm wide may be cut forming a sheet 750×600 or 750×900. Thus wastage will be minimised and the time required to erect the soffit will be greatly reduced. A ventilated panel such as the slotted panel 11a may be incorporated into the soffit assembly 10 if desired or alternatively ventilated supporting assemblies such as is illustrated in FIGS. 7 or 9 may be used to provide ventilation through the soffit assembly.

In the embodiment illustrated in FIG. 4, the supporting member 40 is in the form of an I beam having a small top flange 41 an enlarged bottom flange 42. An intermediate flange 43 co-operates with the bottom flange 42 to form the spaced location means 44 for receiving a respective edge portion of a panel to be supported thereby. The outer edges of the intermediate flange 43 are each formed with a longitudinally extending rib 45 so as to provide a wedge type clamping action upon insertion of a panel into the location means for secure retention therein. This embodiment may be used with a spring steel retaining clip 46 having a notched end portion 48 shaped to fit over the top flange 41 whereby it may be used without forming a slot in the supporting member 40. As illustrated, the notched portion 47 of the clip 46 is substantially the same shape as, but slightly larger than the top flange 41 whereby it may be engaged about the top flange 41 and slid along the flange to the desired clamping position. Upon tilting to its operative attitude the notch portion 48 will clamp securely about the top flange 41. The lower portion of the clip 46 which is not illustrated is adapted to clamp about the fascia as previously described. Alternatively apertures 49 may be provided for engagement by a clip of the type illustratede in FIG. 8.

Figure 5:
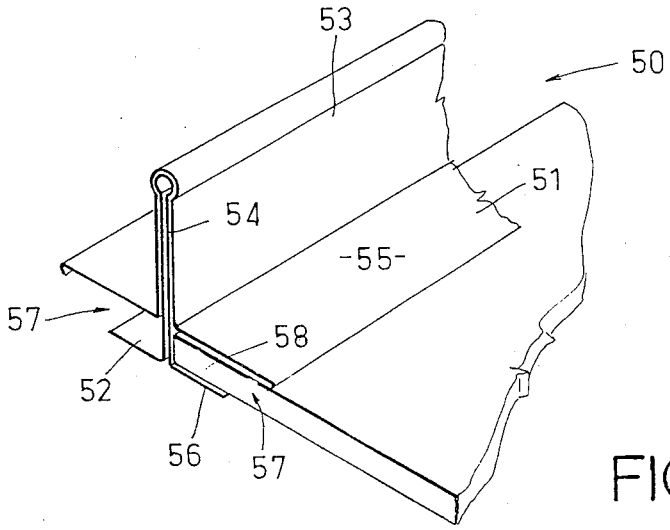
FIG. 5 is a perspective view of a further embodiment of the invention.
Figure 6:
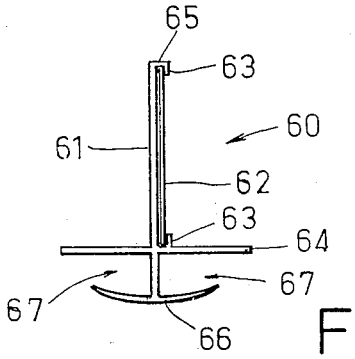
FIG. 6 is a cross-sectional view of a composite supporting assembly formed of plastics and metal.

Further embodiments of the invention are illustrated in FIGS. 5 and 6. The supporting assembly 50 illustrated in FIG. 5 is formed by connecting together two roll formed inverted T-sectioned members 51 and 52 such that the web 53 of the outer member 51 extends about the web 54 of the inner member 52 and with their respective side flanges 55 and 56 spaced apart to provide locating channels 57 for a panel edge 58. Suitably the webs 53 and 54 are spot welded together.

The supporting assembly 60 illustrated in FIG. 6 is a composite assembly formed from a plastics extrusion 61 which is similar to the embodiment illustrated in FIG. 4, (which is preferaby formed as an extruded aluminium section) and a metal stiffening strip 62 held between ribs 63 of the plastics extrusion and extending upwardly from the intermediate flange 64 and downwardly, from the top flange 65. The bottom flange 66 is resilient and is curved upwardly at each end so as to clamp about a panel inserted into the respective location means 67.

As previously indicated, the soffit assembly may be ventilated by using ventilated supporting assemblies such as those illustrated in FIGS. 7 and 9. The ventilated supporting assembly 70 of FIG. 7 includes a substantially open channel shaped member 71 having its open face lowermost and its free edge portions 72 formed into location recesses 73 which are spaced apart to provide an air flow slot 74 therebetween. Suitably each recess 73 has a top wall 75 which extends outwardly beyond its lower wall 76 to facilitate loading a panel 77 therein.

Figure 8:
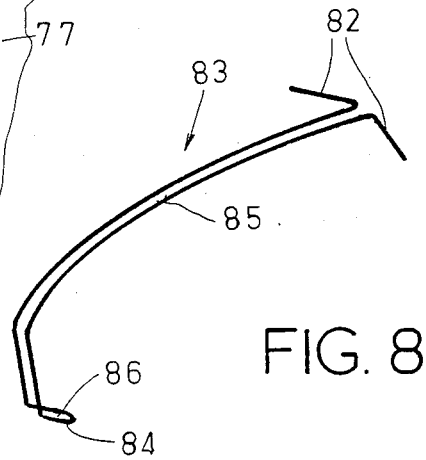
FIG. 8 is a perspective view of a preferred form of retaining clip for use with the supporting assembly of FIG. 7.

The top wall 78 of the channel member 71 as well as both side walls 79 are provided with rows of spaced passages 80 through which air may pass from the slot 74 through the soffit assembly into a ceiling. These passages 80 may be in any configuration but preferably the passages in the side walls 79 are closely spaced apertures 81 adapted for engagement by one of the holding flukes 82 of a retaining clip 83 as illustrated in FIG. 8. The flukes 82 extend acutely to opposite sides of the clip 83 and they are interconnected to a latching portion 84 by means of a curved resilient stem assembly 85 which may be bent resiliently to adjust the length between the flukes 82 and the latching portion 84. The apertures 81 in the side walls 79 are closely spaced to enable relatively fine longitudinal adjustment of the engagement between the clip 83 and the assembly 70.

In use, the supporting assembly 70 is cut to length to fit between the fascia and the wall and a clip 83 is arranged at one side of the supporting assembly 70 with the appropriate fluke 82 engaged with a selected aperture 81 in either side wall 79. The clip 83 is so positioned that when it is pivoted about the engaged fluke 82, the latching portion 84 will engage about the back wall of the soffit retaining channel in the fascia. Thereafter force will have to be exerted to push latching portion 84 downwards into its engaged position about the lower edge of the soffit panel retaining channel. This force will resiliently extend the stem 85 so that it will maintain the outer end of the supporting assembly 70 in tight engagement with the fascia. If the supporting assembly 70 is used in conjunction with a timber fascia, the clip 83 is turned upside down and engaged with a fluke 82 in an aperture 81 whereby the outermost extremity of the latching portion 84 will terminate short of the end of the supporting assembly 70. A clout or the like fastener is then passed through the slot 86 in the latching portion 84 and hammered into the fascia to retain the clip 83 and thereby maintain the supporting assembly 70 firmly in abutment with the fascia.

The ventilated supporting assembly 90 illustrated in FIG. 9 is formed from a top-hat sectioned beam 91 having tabs 92 folded down from the side walls 93 in spaced relationship with the lower flanges 94 to provide longitudinally spaced panel edge location means 95 as well as the air flow passages 96.

The supporting assemblies of this invention may be utilized advantageously in many applications besides the erection of soffits. For example in general repair or renovation work, wall panels can be joined utilizing the present invention eliminating the need to install nogging behind existing framework or studs, to effect the joint.

It will of course be realised that the above has been given by way of illustrative example of the invention only, and that all modifications and variations thereto as would be apparent to persons skilled in the art are deemed to fall within the broad scope and ambit of the invention as is defined in the appended claims.

The claims defining the invention are as follows:

1. An eave assembly comprising:

a fascia spaced from a wall;

inner and outer longitudinal frame means extending along the wall and the fascia respectively, and soffit panels arranged in end-to-end relationship along the eave with their opposite longitudinal sides secured to said inner and outer longitudinal frame means;

transverse elongate supporting members terminating between and adjacent said inner and outer frame means, each said transverse elongate supporting member being formed as a plastics extrusion and having web means extending upwardly from a horizontally extending lower flange and beyond an intermediate flange which is spaced from said lower flange a distance greater than the thickness of the soffit panels, said lower flange and said intermediate flange extending beyond opposite sides of said web means to form respective opposed channel shaped panel edge recesses in which respective adjacent transverse edges of said panels are secured;

said intermediate flange having respective extension portions which extend outwardly beyond opposite sides of said lower flange and downwardly into firm engagement with respective said soffit panels whereby said soffit panels are forced into tight engagement with said lower flange, and whereby soffit panels may, during erection or repair of said eave assembly, be inserted into a respective said panel edge recess from beneath said frame means and subsequently be secured thereto from beneath said panels;

said transverse elongated supporting members each forming a beam which extends stiffly between said inner and outer frame means whereby the load applied to each elongate supporting member through respective said transverse edges is transferred by said elongate supporting members to the opposite side portions of said panels at respective locations inwardly of said inner and outer longitudinal frame means.

2. An eave assembly as defined in claim 1, wherein said intermediate flange of each elongate member is provided with retaining means which engage with said soffit panels and resist disengagement of said panels from said elongate supporting members.

3. An eave assembly as defined in claim 1, wherein each said elongate supporting member is a hollow beam and said opposed panel edge recesses are spaced apart whereby air may flow therebetween into said hollow beam, the latter being provided with air passages therein through which air may flow into the space above said beam.

4. A method of erecting an eave assembly as defined in claim 1, the method including securing a soffit panel to said inner and outer frame means; forming said elongate supporting member to a length whereby it may extend between said inner and outer frame means; engaging said formed elongate supporting member with said transverse edge of the secured soffit panel; engaging the said transverse edge of a further soffit panel with said formed elongate supporting member; securing said further soffit panel to said inner and outer frame means and repeating the above steps to form said eave assembly.

5. A method according to claim 4, wherein said soffit panels are cut from sheet material supplied in rectangular sheets having formed longitudinal edges which are many times longer than the distance between said fascia and said wall, the method further including the steps of cutting said rectangular sheets widthwise at intervals equal to the desired soffit panel widths, and utilizing said formed longitudinal edges of the cut sheet portions as said transverse edges of said soffit panels.

6. An elongate support member for use in an eave assembly as defined in claim 1, said elongate supporting member having a lower flange; said web extending upwardly from said lower flange; an intermediate flange on said web having an inner portion adjacent to said web which overlies said lower flange and being spaced therefrom a distance greater than the thickness of a soffit panel and extension portions which extend outwardly beyond said lower flange and downwardly towards said lower flange.

7. An elongate supporting member as defined in claim 6, wherein the upper surface of said lower flange is disposed at right angles to said web.

8. An eave assembly as defined in claim 1, wherein one of said opposed panel retaining means includes an outer edge portion extending therefrom which is tapered and deflected inwardly to intrude into a zone to be occupied by an edge of the panel such that the tapered deflecting portion presses firmly against the back of the panel for forcing thereof into engagement with the other of said opposed panel retaining means.

9. An eave assembly as defined in claim 1, wherein said elongate supporting member is an open beam and includes air passages, and said opposed panel edge recesses are spaced apart to provide for air flow therebetween into said open beam and through said air passages into the space above said beam.

10. An eave assembly as defined in claim 1, wherein said elongate supporting member includes a lower and an intermediate flange having an inner portion adjacent said web which overlies said lower flange and is spaced therefrom a distance greater than the thickness of said soffit panel, and extension portions extending from said intermediate flange outwardly beyond said lower flange and downwardly into firm engagement with said adjacent soffit panels whereby said panels are forced into tight engagement with said lower flange and installation from below can take place.

11. An eave assembly as defined in claim 1, wherein said intermediate flange of each said elongate member includes retaining means for engagement with said soffit panels and resists engagement of said panels from said elongate supporting members.

12. The elongate supporting member as defined in claim 1, including further extension portions having openings to permit air circulation around said flanges.

13. An elongate support member for use in an eave assembly as defined in claim 1, said elongate supporting member having a lower flange; said web extending upwardly from said lower flange; an intermediate flange on said web having an inner portion adjacent to said web which overlies said lower flange and being spaced therefrom a distance greater than the thickness of a soffit panel and extension portions which extend outwardly beyond said lower flange and downwardly towards said lower flange.

14. An eave assembly comprising:

a fascia spaced from a wall;

inner and outer frame means extending along the wall and the fascia respectively, and soffit panels arranged in end-to-end relationship along the eave with their opposite sides supported by said inner and outer frame means;

elongate supporting members, adjacent pairs of transverse edges of said soffit panels which span between said inner and outer frame means being supported by said elongate supporting members which respectively extend between and terminate inwardly of said inner and outer frame means; and said elongate supporting members having opposed panel retaining means thereon which engage the respective said transverse edges whereby the load applied to each elongate supporting member through respective said transverse edges is transferred by said elongate supporting members to said portions of the soffit panels inwardly of said inner and outer frame means;

each said elongate supporting member having a web extending upwardly from a lower flange whereby said elongate supporting member is a beam which extends stiffly between said inner and outer frame means and wherein said web has an intermediate flange which cooperates with said lower flange to form channel-shaped panel edge recesses at opposite sides of said web in which said transverse edges are engaged; and said elongate supporting member including a lower and an intermediate flange having an inner portion adjacent said web which overlies said lower flange and is spaced therefrom a distance greater than the thickness of said soffit panel, and extension portions extending from said intermediate flange outwardly beyond said lower flange and downwardly into firm engagement with said adjacent soffit panels whereby said panels are forced into tight engagement with said lower flange and installation from below can take place.

15. An eave assembly as defined in claim 14, wherein said intermediate flange has an inner portion adjacent to said web which overlies said lower flange and is spaced therefrom a distance greater than the thickness of said soffit panel and extension portions which extend outwardly beyond said lower flange and downwardly into firm engagement with said adjacent soffit panels whereby said panels are forced into tight engagement with said lower flange.

16. An elongate supporting member as defined in claim 14, wherein said flanges and said web are formed integrally by a resilient material.

17. The elongate supporting member as defined in claim 16, including further extension portions having openings to permit air circulation around said flanges.

18. An eave assembly as defined in claim 14, wherein said intermediate flange of each elongate member is provided with retaining means which engage with said soffit panels and resist disengagement of said panels from said elongate supporting members.

19. A method of erecting an eave assembly as defined in claim 14, the method including securing a soffit panel to said inner and outer frame means; forming said elongate supporting member to a length whereby it may extend between said inner and outer frame means; engaging said formed elongate supporting member with said transverse edge of the secured soffit panel; engaging the said transverse edge of a further soffit panel with said formed elongate supporting member; securing said further soffit panel to said inner and outer frame means and repeating the above steps to form said eave assembly.

20. A method according to claim 19, wherein said soffit panels are cut from sheet material supplied in rectangular sheets having formed longitudinal edges which are many times longer than the distance between said fascia and said wall, the method further including the steps of cutting said rectangular sheets widthwise at intervals equal to the desired soffit panel widths, and utilizing said formed longitudinal edges of the cut sheet portions as said transverse edges of said soffit panels.

* * * * *